US011618858B1

(12) United States Patent
Koseoglu et al.

(10) Patent No.: US 11,618,858 B1
(45) Date of Patent: Apr. 4, 2023

(54) HYDRODEARYLATION CATALYSTS FOR AROMATIC BOTTOMS OIL, METHOD FOR PRODUCING HYDRODEARYLATION CATALYSTS, AND METHOD FOR HYDRODEARYLATING AROMATIC BOTTOMS OIL WITH HYDRODEARYLATION CATALYSTS

(71) Applicants: Saudi Arabian Oil Company, Dhahran (SA); JGC Catalysts and Chemicals Ltd., Kawasaki (JP); Japan Cooperation Center Petroleum, Tokyo (JP)

(72) Inventors: Omer Refa Koseoglu, Dhahran (SA); Robert Peter Hodgkins, Dhahran (SA); Koji Uchida, Kanagawa (JP)

(73) Assignees: Saudi Arabian Oil Company, Dhahran (SA); JGC Catalysts and Chemicals Ltd., Kawasaki (JP); Japan Cooperation Center Petroleum, Tokyo (JP)

( * ) Notice: Subject to any disclaimer, the term of this patent is extended or adjusted under 35 U.S.C. 154(b) by 0 days.

(21) Appl. No.: 17/542,724

(22) Filed: Dec. 6, 2021

(51) Int. Cl.
*C10G 49/08* (2006.01)
*C10G 47/16* (2006.01)
*C10G 47/04* (2006.01)

(52) U.S. Cl.
CPC ..... *C10G 47/16* (2013.01); *C10G 47/04* (2013.01); *C10G 49/08* (2013.01); *C10G 2300/1096* (2013.01); *C10G 2400/30* (2013.01)

(58) Field of Classification Search
CPC ..... C10G 49/08; C10G 47/16; C10G 47/04; C10G 2300/1096; C10G 2300/30
See application file for complete search history.

(56) References Cited

U.S. PATENT DOCUMENTS

| | | | | |
|---|---|---|---|---|
| 3,523,914 | A | 8/1970 | Mitsche et al. | |
| 3,842,138 | A | 10/1974 | Chahvekilian et al. | |
| 3,944,481 | A | 3/1976 | Wing et al. | |
| 4,002,556 | A | 1/1977 | Satchell | |
| 4,065,379 | A | 12/1977 | Soonawala et al. | |
| 4,115,467 | A | 9/1978 | Fowler | |
| 4,180,453 | A | 12/1979 | Franck et al. | |
| 4,210,560 | A | 7/1980 | Kehl | |
| 4,255,288 | A * | 3/1981 | Cull | C10G 49/08 502/66 |
| 4,419,271 | A | 12/1983 | Ward | |
| 4,447,315 | A * | 5/1984 | Lamb | C10G 25/00 208/48 R |
| 4,698,322 | A | 10/1987 | Santilli et al. | |
| 4,738,941 | A | 4/1988 | Dufresne et al. | |
| 4,798,665 | A | 1/1989 | Humbach et al. | |
| 4,826,586 | A | 5/1989 | Herbst et al. | |
| 4,859,308 | A | 8/1989 | Harandi et al. | |
| 5,057,203 | A | 10/1991 | Chu et al. | |
| 5,185,484 | A | 2/1993 | Del Rossi et al. | |
| 5,192,421 | A | 3/1993 | Audeh et al. | |
| 5,258,117 | A | 11/1993 | Kolstad et al. | |
| 5,264,635 | A | 11/1993 | Le et al. | |
| 5,271,761 | A | 12/1993 | Skeels et al. | |
| 5,414,175 | A | 5/1995 | Cook | |
| 5,690,810 | A | 11/1997 | Lawrence et al. | |
| 5,906,728 | A | 5/1999 | Iaccino et al. | |
| 6,017,840 | A | 1/2000 | Wu et al. | |
| 6,063,944 | A | 5/2000 | Di Renzo et al. | |
| 6,132,494 | A | 10/2000 | Kjos et al. | |
| 6,190,533 | B1 | 2/2001 | Bradow et al. | |
| 6,210,561 | B1 | 4/2001 | Bradow et al. | |
| 6,303,842 | B1 | 10/2001 | Bridges et al. | |
| 6,632,351 | B1 | 10/2003 | Ngan et al. | |
| 6,726,834 | B2 | 4/2004 | Quesada et al. | |
| 6,762,143 | B2 | 7/2004 | Shan et al. | |
| 7,084,087 | B2 | 8/2006 | Shan et al. | |
| 7,220,887 | B2 | 5/2007 | Stell et al. | |
| 7,331,746 | B2 | 2/2008 | Wright et al. | |
| 7,408,093 | B2 | 8/2008 | Stell et al. | |
| 7,550,405 | B2 | 6/2009 | Shan et al. | |
| 7,700,005 | B2 | 4/2010 | Inui et al. | |
| 7,951,745 | B2 | 5/2011 | Zhou et al. | |

(Continued)

FOREIGN PATENT DOCUMENTS

| | | | |
|---|---|---|---|
| CA | 2041905 | A1 | 11/1991 |
| CN | 101134576 | A | 3/2008 |

(Continued)

OTHER PUBLICATIONS

International Search Report pertaining to Application No. PCT/US2015/032129 dated Aug. 21, 2015, 16 pages.
Wang et al., "Characterization of titanium-modified USY zeolites and their catalytic performance on n-heptane cracking", Appl Catal A-Gen, vol. 214, No. 2, pp. 167-177, Jun. 29, 2001.
International Search Report pertaining to Application No. PCT/US2013/023337 dated Jun. 18, 2013, 15 pages.
Office action pertaining to JP2017-098615 dated Mar. 9, 2018, 9 pages.
International Search Report pertaining to Application No. PCT/US2018/064001 dated Feb. 18, 2019.

(Continued)

*Primary Examiner* — Michelle Stein
(74) *Attorney, Agent, or Firm* — Dinsmore & Shohl LLP

(57) ABSTRACT

In accordance with one or more embodiments of the present disclosure, a method for hydrodearylating aromatic bottoms oil includes contacting at least one aromatic bottoms oil stream with at least one catalyst composition and hydrogen in a reactor in order to hydrodearylate the aromatic bottoms oil stream. The catalyst composition includes a catalyst support comprising framework-substituted ultra-stable Y-type (USY) zeolite substituted with at least zirconium atoms. The catalyst composition does not include a hydrogenative metal component disposed on the support.

9 Claims, No Drawings

(56) References Cited

U.S. PATENT DOCUMENTS

| | | | | |
|---|---|---|---|---|
| 7,972,498 | B2 | 7/2011 | Buchanan et al. | |
| 8,002,970 | B2 | 8/2011 | Euzen et al. | |
| 8,008,226 | B2 | 8/2011 | Inui et al. | |
| 8,070,938 | B2 | 12/2011 | Stein et al. | |
| 8,071,833 | B2 | 12/2011 | Grootjans et al. | |
| 8,148,285 | B2 | 4/2012 | Kuroda et al. | |
| 8,884,088 | B2 | 11/2014 | Smith et al. | |
| 9,108,190 | B1 | 8/2015 | Fan et al. | |
| 9,221,036 | B2 | 12/2015 | Koseoglu et al. | |
| 9,321,704 | B2 | 4/2016 | Lattner et al. | |
| 9,499,403 | B2 | 11/2016 | Al-Muhaish et al. | |
| 9,512,371 | B2 | 12/2016 | Abe et al. | |
| 9,879,187 | B2 | 1/2018 | Bhan | |
| 9,908,109 | B2 | 3/2018 | Ravishankar et al. | |
| 10,053,401 | B1 | 8/2018 | Beadle et al. | |
| 10,081,009 | B2 | 9/2018 | Koseoglu et al. | |
| 10,137,442 | B2 | 11/2018 | Mcguire | |
| 10,293,332 | B2 | 5/2019 | Koseoglu et al. | |
| 10,350,585 | B1 | 7/2019 | Al-Herz et al. | |
| 10,427,142 | B1 | 10/2019 | Al-Herz et al. | |
| 10,494,574 | B2 | 12/2019 | Akah et al. | |
| 10,941,354 | B1 * | 3/2021 | Hodgkins | B01J 29/89 |
| 10,961,470 | B1 * | 3/2021 | Koseoglu | C10G 67/02 |
| 11,021,665 | B1 * | 6/2021 | Koseoglu | C10G 65/10 |
| 11,078,431 | B2 * | 8/2021 | Koseoglu | C07C 2/66 |
| 11,098,256 | B2 * | 8/2021 | Koseoglu | B01J 29/088 |
| 11,110,428 | B2 * | 9/2021 | Koseoglu | C10G 47/00 |
| 11,142,703 | B1 * | 10/2021 | Koseoglu | B01J 35/1038 |
| 11,149,220 | B2 * | 10/2021 | Hodgkins | C10G 47/30 |
| 11,154,845 | B1 * | 10/2021 | Koseoglu | B01J 29/7057 |
| 11,268,037 | B2 * | 3/2022 | Koseoglu | C10G 65/043 |
| 11,274,068 | B2 * | 3/2022 | Koseoglu | C07C 6/04 |
| 11,332,678 | B2 * | 5/2022 | Koseoglu | C10G 35/085 |
| 11,420,192 | B2 * | 8/2022 | Koseoglu | B01J 37/04 |
| 11,433,379 | B2 * | 9/2022 | Koseoglu | C07C 5/2729 |
| 11,484,869 | B2 * | 11/2022 | Koseoglu | B01J 29/088 |
| 2003/0006168 | A1 | 1/2003 | Ino et al. | |
| 2004/0004028 | A1 | 1/2004 | Stell et al. | |
| 2004/0045869 | A1 | 3/2004 | Benazzi et al. | |
| 2004/0054247 | A1 | 3/2004 | Powers | |
| 2005/0209093 | A1 | 9/2005 | Chester et al. | |
| 2005/0232839 | A1 | 10/2005 | Yaluris et al. | |
| 2005/0261530 | A1 | 11/2005 | Stell et al. | |
| 2006/0021912 | A1 | 2/2006 | Chen et al. | |
| 2007/0090018 | A1 | 4/2007 | Keusenkothen et al. | |
| 2007/0090020 | A1 | 4/2007 | Buchanan et al. | |
| 2007/0232846 | A1 | 10/2007 | Baumgartner et al. | |
| 2009/0283443 | A1 | 11/2009 | Kuroda et al. | |
| 2010/0087692 | A1 | 4/2010 | Yoshimura et al. | |
| 2011/0042269 | A1 | 2/2011 | Kuechler et al. | |
| 2011/0132804 | A1 | 6/2011 | Stevenson et al. | |
| 2011/0174682 | A1 | 7/2011 | Iaccino | |
| 2011/0247500 | A1 | 10/2011 | Akhras et al. | |
| 2011/0251049 | A1 | 10/2011 | Kuroda et al. | |
| 2011/0270004 | A1 * | 11/2011 | Yanagawa | C10G 45/68 502/61 |
| 2012/0085681 | A1 | 4/2012 | Abe et al. | |
| 2013/0046122 | A1 | 2/2013 | Vermeiren et al. | |
| 2013/0175202 | A1 * | 7/2013 | Koseoglu | B01J 37/0201 502/67 |
| 2013/0299388 | A1 | 11/2013 | Bulut et al. | |
| 2013/0319910 | A1 | 12/2013 | Koseoglu et al. | |
| 2014/0163259 | A1 * | 6/2014 | Dakka | B01J 29/90 568/376 |
| 2015/0111721 | A1 | 4/2015 | Tian et al. | |
| 2015/0111722 | A1 | 4/2015 | Long et al. | |
| 2015/0375218 | A1 * | 12/2015 | Koseoglu | B01J 29/89 502/68 |
| 2017/0088490 | A1 | 3/2017 | Chen et al. | |
| 2018/0230070 | A1 * | 8/2018 | Beadle | C07C 4/26 |
| 2019/0022630 | A1 * | 1/2019 | Koseoglu | B01J 23/755 |
| 2019/0093028 | A1 | 3/2019 | Gong et al. | |
| 2019/0147345 | A1 | 5/2019 | Lu et al. | |
| 2019/0224653 | A1 * | 7/2019 | Koseoglu | B01J 23/40 |
| 2019/0241486 | A1 * | 8/2019 | Koseoglu | C07C 4/26 |
| 2019/0316044 | A1 * | 10/2019 | Koseoglu | B01J 37/0009 |
| 2021/0102129 | A1 * | 4/2021 | Hodgkins | C10G 69/08 |
| 2021/0130712 | A1 * | 5/2021 | Abudawoud | C10G 63/04 |

FOREIGN PATENT DOCUMENTS

| | | | |
|---|---|---|---|
| CN | 101898144 | A | 12/2010 |
| CN | 104549543 | A | 4/2015 |
| CN | 106140289 | A | 11/2016 |
| CN | 106145136 | A | 11/2016 |
| EP | 703003 | A1 | 3/1996 |
| EP | 2298445 | A1 | 3/2011 |
| EP | 3406337 | A1 | 11/2018 |
| GB | 1255544 | A | 12/1971 |
| GB | 2114594 | A | 8/1983 |
| JP | 58098387 | A | 6/1983 |
| JP | 07308581 | A | 11/1995 |
| JP | 2000334305 | A | 12/2000 |
| JP | 2002255537 | A | 9/2002 |
| JP | 2003226519 | A | 8/2003 |
| WO | 8801254 | A1 | 2/1988 |
| WO | 0104237 | A2 | 1/2001 |
| WO | 2007047942 | A2 | 4/2007 |
| WO | 2009088413 | A1 | 7/2009 |
| WO | 2012018819 | A1 | 2/2012 |
| WO | 2013057319 | A2 | 4/2013 |
| WO | 2013123299 | A1 | 8/2013 |
| WO | 2015179735 | A1 | 11/2015 |
| WO | 2020147345 | A1 | 7/2020 |

OTHER PUBLICATIONS

Hamdy et al., "Structural and photocatalytic properties of precious metals modified TiO2-BEA Zeolite composites", Molecular Catalysis, vol. 441, pp. 140-149, 2017.

Rakshe et al., "Acidity and m-Xylene Isomerization Activity of Large Pore, Zirconium-Containing Alumino-silicate with BEA Structure", Journal of Catalysis, vol. 188, pp. 252-260, 1999.

Reddy et al., "A Simple Method for the Preparation of Active Ti Beta Zeolite Catalysts", Catalysisby Microporous Materials, Studies int eh Surface Science and Catalysis, vol. 94, pp. 309-316, 1995.

International Search Report and Written Opinion dated Mar. 17, 2021 pertaining to International application No. PCT/US2020/058682 filed Nov. 3, 2020, 16 pgs.

International Search Report and Written Opinion dated Mar. 31, 2021 pertaining to International application No. PCT/US2020/057484 filed Oct. 27, 2020, 14 pgs.

International Search Report and Written Opinion dated Apr. 9, 2021 pertaining to International application No. PCT/US2020/060860 filed Nov. 17, 2020, 12 pgs.

International Search Report and Written Opinion dated Apr. 13, 2021 pertaining to International application No. PCT/US2020/066520 filed Dec. 22, 2020, 12 pgs.

International Search Report and Written Opinion dated Apr. 21, 2021 pertaining to International application No. PCT/US2020/058208 filed Oct. 30, 2020, 12 pgs.

Notice of Allowance and Fee(s) Due dated Jun. 9, 2021 pertaining to U.S. Appl. No. 16/985,588, filed Aug. 5, 2020, 35 pages.

U.S. Office Action dated Jul. 6, 2021 pertaining to U.S. Appl. No. 16/936,990, filed Jul. 23, 2020, 35 pages.

U.S. Office Action dated Jul. 8, 2021 pertaining to U.S. Appl. No. 16/923,346, filed Jul. 8, 2020, 35 pages.

U.S. Notice of Allowance and Fee(s) Due dated Aug. 4, 2021 pertaining to U.S. Appl. No. 16/940,635, filed Jul. 28, 2020, 42 pages.

U.S. Office Action dated Aug. 6, 2021 pertaining to U.S. Appl. No. 16/940,711, filed Jul. 28, 2020, 40 pages.

U.S. Notice of Allowance and Fee(s) Due dated Nov. 9, 2021 pertaining to U.S. Appl. No. 16/936,990, filed Jul. 23, 2020, 20 pages.

U.S. Office Action dated Dec. 2, 2021 pertaining to U.S. Appl. No. 16/936,987, filed Jul. 23, 2020, 53 pages.

U.S. Office Action dated Feb. 4, 2022 pertaining to U.S. Appl. No. 16/940,711, filed Jul. 28, 2020, 23 pages.

(56) References Cited

OTHER PUBLICATIONS

U.S. Office Action dated Feb. 14, 2022 pertaining to U.S. Appl. No. 16/923,346, filed Jul. 8, 2020, 22 pages.
U.S. Notice of Allowance and Fee(s) Due dated Mar. 9, 2022 pertaining to U.S. Appl. No. 16/936,987, filed Jul. 23, 2020, 9 pages.

* cited by examiner

HYDRODEARYLATION CATALYSTS FOR AROMATIC BOTTOMS OIL, METHOD FOR PRODUCING HYDRODEARYLATION CATALYSTS, AND METHOD FOR HYDRODEARYLATING AROMATIC BOTTOMS OIL WITH HYDRODEARYLATION CATALYSTS

FIELD

Embodiments of the present disclosure generally relate to hydrodearylating aromatic bottoms oil, and pertain particularly to a catalyst composition for hydrodearylating aromatic bottoms oil, methods of making such catalyst compositions, and methods of using such catalyst compositions.

BACKGROUND

Hydrodearylation is a recently developed process for cleaving the alkyl bridge of non-condensed alkyl-bridged multi-aromatics or heavy alkyl aromatic compounds to form alkyl mono-aromatics, in the presence of a catalyst and hydrogen. As such, hydrodearylation has many attributes in common with traditional hydrocracking.

In the hydrodearylation process, the aromatic recovery complex bottoms containing $C_9$+ or $C_{11}$+ aromatics are upgraded to produce benzene, toluene, ethylbenzene, and xylenes. The process focuses on capturing the value lost when aromatic olefins such as styrene in the $C_8$+ stream are alkylated by another aromatic molecule to form heavy alkyl-bridged, non-condensed alkyl aromatics in the deolefination step over an acidic clay or zeolytic catalyst. The reject stream from the aromatics complex is subjected to hydrodearylation, which specifically targets the bridged di-aromatic molecules, e.g., alkylated bibenzyl molecules, at relatively low temperatures and pressures. As used herein, the term "hydrodearylation" refers to a process for the cleaving of the alkyl bridge of the non-condensed di-aromatics.

Hydrocracking processes are used commercially in a large number of petroleum refineries to process a variety of hydrocarbon feeds boiling in the range of 370° C. to 520° C. in conventional hydrocracking units and boiling at 520° C. and above in residue hydrocracking units. In general, hydrocracking processes split the molecules of the hydrocarbon feed into smaller, i.e., lighter, molecules having higher average volatility and economic value. Additionally, hydrocracking processes typically improve the quality of the hydrocarbon feedstock by increasing the hydrogen-to-carbon ratio and by removing organosulfur and organonitrogen compounds. The hydrocracking catalyst is a key feature of hydrocracking process technologies.

Two types of catalysts used in hydrocracking: pretreat catalysts and cracking catalysts. Pretreat catalysts are designed to remove contaminants, such as sulfur and nitrogen, from the heavy hydrocarbon oil. Cracking catalysts are designed to split low-value heavy molecules into higher value transportation fuels. The cracking catalysts are typically composed of active phase metals for hydrogenation, amorphous support as a binder, and zeolites as a cracking component. Active phase metals typically include nickel, molybdenum, and tungsten. Exemplary zeolites include ultra-stable Y-type zeolites (USY zeolites).

Hydrocracking catalysts may be used for the hydrodearylation process. However, hydrocracking catalysts are overdesigned for the hydrodearylation process and there is no need for hydrodearylation catalysts to have hydrodesulfurization, hydrodenitrogenation, and hydrogenation functions, such as would be provided by active phase metals.

SUMMARY

There is a continual need for more effective hydrodearylation catalyst compositions. It has been discovered that a catalyst composition including at least one framework-substituted ultra-stable Y-type (hereinafter "USY") zeolite with no active phase metal disposed on the framework-substituted USY zeolite may greatly enhance the effectiveness of hydrodearylation processes.

According to embodiments, a method for hydrodearylating aromatic bottoms oil includes contacting at least one aromatic bottoms oil stream with at least one catalyst composition and hydrogen in a reactor in order to hydrodearylate the aromatic bottoms oil stream. The catalyst composition includes a catalyst support comprising framework-substituted ultra-stable Y-type (USY) zeolite substituted with zirconium atoms and/or hafnium atoms. The catalyst composition does not include a hydrogenative metal component disposed on the support.

According to embodiments, a catalyst composition includes a catalyst support comprising framework-substituted ultra-stable Y-type (USY) zeolite substituted with zirconium atoms and/or hafnium atoms. The catalyst composition does not include a hydrogenative metal component disposed on the support.

Additional features and advantages of the embodiments described herein will be set forth in the detailed description which follows, and in part will be readily apparent to those skilled in the art from that description or recognized by practicing the embodiments described, including the detailed description and the claims which are provided infra.

DETAILED DESCRIPTION

In one aspect, a method for hydrodearylating aromatic bottoms oil includes contacting at least one aromatic bottoms oil stream with at least one catalyst composition and hydrogen in a reactor in order to hydrodearylate the aromatic bottoms oil stream. The catalyst composition may include a catalyst support including at least one USY zeolite having a framework substituted with titanium and/or zirconium and/or hafnium (hereinafter "FS-USY zeolite"). The catalyst composition does not include a hydrogenative metal component disposed on the support.

As used herein, the term "aromatic bottoms oil" or "aromatic bottoms feedstock" or "aromatic bottoms feed" refers to an oily liquid composed mostly of a mixture of aromatic hydrocarbon compounds. Aromatic bottoms oil may include an aromatic bottoms stream obtained from an aromatic recovery complex. An aromatic bottoms stream may boil in a range of 150° C. to 450° C. and may contain heavy alkyl aromatic compounds and alkyl-bridged non-condensed multi-aromatic compounds. The alkyl-bridged non-condensed alkyl multi-aromatic compounds may include at least two benzene rings connected by an alkyl bridge group having at least two carbons.

As used herein, the term "hydrocarbon" refers to a chemical compound composed entirely of carbon and hydrogen atoms. An expression such as "$C_x$-$C_y$ hydrocarbon" refers to a hydrocarbon having from x to y carbon atoms. For instance, a $C_1$-$C_5$ hydrocarbon includes methane, ethane, propane, the butanes, and the pentanes.

As used herein, the term "crystal lattice constant" refers to a physical dimension of unit cells in a crystal lattice. The crystal lattice constant can be determined by ASTM D3942-03, entitled "Standard Test Method for Determination of the Unit Cell Dimension of a Faujasite-Type Zeolite," the entire content of which is incorporated herein by reference.

As used herein, the term "specific surface area" refers to the total surface area of the zeolite or catalyst per unit of mass. The specific surface area can be determined by ASTM D3663-03, entitled "Standard Test Method for Surface Area of Catalysts and Catalyst Carriers," the entire content of which is incorporated herein by reference. Alternatively, the specific surface area may be determined using the Brunauer-Emmett-Teller ("BET") model. Alternatively, the specific surface area can be determined by ASTM D4365-19, entitled "Standard Test Method for Determining Micropore Volume and Zeolite Area of a Catalyst," the entire content of which is incorporated herein by reference.

As used herein, the term "hydrogen/oil ratio" or "hydrogen-to-oil ratio" refers to a standard measure of the volume rate of hydrogen circulating through the reactor with respect to the volume of feed. The hydrogen/oil ratio may be determined by comparing the flow volume of the hydrogen gas stream and the flow volume of the aromatic bottoms feed using standard flow meters.

As used herein, the term "liquid hourly space velocity" or "LHSV" refers to the ratio of the liquid flow rate of the aromatic bottoms feed to the catalyst volume or mass.

As used herein, the term "activity of the catalyst" or "catalytic activity" refers to the increase in the rate of the hydrodearylation process due to the presence of the catalyst and may be approximated by the temperature at which 50% conversion of the feedstock is converted. A more highly active catalyst will have a lower such temperature.

In embodiments, the catalyst composition may consist of the support. In embodiments, the catalyst composition may comprise the support and other additives, discussed more fully below. In embodiments, the catalyst composition may comprise from 1 wt. % to 99.99 wt. % support. For example, the catalyst composition may comprise from 1 wt. % to 95 wt. %, from 1 wt. % to 90 wt. %, from 1 wt. % to 85 wt. %, from 1 wt. % to 80 wt. %, from 1 wt. % to 75 wt. %, from 1 wt. % to 70 wt. %, from 1 wt. % to 65 wt. %, 1 wt. % to 60 wt. %, from 1 wt. % to 55 wt. %, from 1 wt. % to 50 wt. %, from 1 wt. % to 45 wt. %, from 1 wt. % to 40 wt. %, from 1 wt. % to 35 wt. %, from 1 wt. % to 30 wt. %, from 1 wt. % to 25 wt. %, from 1 wt. % to 20 wt. %, from 1 wt. % to 15 wt. %, from 1 wt. % to 10 wt. %, from 1 wt. % to 5 wt. %, from 5 wt. % to 99.99 wt. %, from 10 wt. % to 99.99 wt. %, from 15 wt. % to 99.99 wt. %, from 20 wt. % to 99.99 wt. %, from 25 wt. % to 99.99 wt. %, from 30 wt. % to 99.99 wt. %, from 35 wt. % to 99.99 wt. %, from 40 wt. % to 99.99 wt. %, from 45 wt. % to 99.99 wt. %, from 50 wt. % to 99.99 wt. %, from 55 wt. % to 99.99 wt. %, from 60 wt. % to 99.99 wt. %, from 65 wt. % to 99.99 wt. %, from 70 wt. % to 99.99 wt. %, from 75 wt. % to 99.99 wt. %, from 80 wt. % to 99.99 wt. %, from 85 wt. % to 99.99 wt. %, from 90 wt. % to 99.99 wt. %, or even from 95 wt. % to 99.99 wt. % support. It should be understood that the catalyst composition may comprise an amount of the support in a range formed from any of the lower bounds for such a range described herein to any of the upper bounds for such a range described herein.

The catalyst support may include at least one FS-USY zeolite, where the framework is substituted with titanium ("Ti") and/or zirconium ("Zr") and/or hafnium ("Hf"). In embodiments, the catalyst support may include from 0.1 wt. % to 90 wt. % FS-USY zeolite. For example, the catalyst support may comprise from 0.1 wt. % to 85 wt. %, from 0.1 wt. % to 80 wt. %, from 0.1 wt. % to 75 wt. %, from 0.1 wt. % to 70 wt. %, from 0.1 wt. % to 65 wt. %, from 0.1 wt. % to 60 wt. %, from 0.1 wt. % to 55 wt. %, from 0.1 wt. % to 50 wt. %, from 0.1 wt. % to 45 wt. %, from 0.1 wt. % to 40 wt. %, from 0.1 wt. % to 35 wt. %, from 0.1 wt. % to 30 wt. %, from 0.1 wt. % to 25 wt. %, from 0.1 wt. % to 20 wt. %, from 0.1 wt. % to 15 wt. %, from 0.1 wt. % to 10 wt. %, from 0.1 wt. % to 5 wt. %, from 0.1 wt. % to 1 wt. %, from 1 wt. % to 90 wt. %, from 5 wt. % to 90 wt. %, from 5 wt. % to 80 wt. %, from 10 wt. % to 90 wt. %, from 10 wt. % to 75 wt. %, from 15 wt. % to 90 wt. %, from 15 wt. % to 70 wt. %, from 20 wt. % to 90 wt. %, from 20 wt. % to 65 wt. %, from 25 wt. % to 90 wt. %, from 25 wt. % to 60 wt. %, from 30 wt. % to 90 wt. %, from 30 wt. % to 55 wt. %, from 35 wt. % to 90 wt. %, from 35 wt. % to 50 wt. %, from 40 wt. % to 90 wt. %, from 40 wt. % to 45 wt. %, from 45 wt. % to 90 wt. %, from 50 wt. % to 90 wt. %, from 55 wt. % to 90 wt. %, from 60 wt. % to 90 wt. %, from 65 wt. % to 90 wt. %, from 70 wt. % to 90 wt. %, from 75 wt. % to 90 wt. %, from 80 wt. % to 90 wt. %, or even from 85 wt. % to 90 wt. % FS-USY zeolite. It should be understood that the catalyst support may comprise an amount of the FS-USY zeolite in a range formed from any of the lower bounds for such a range described herein to any of the upper bounds for such a range described herein. Without intending to be bound by any particular theory, it is believed that when the amount of zeolite in the catalyst support is above 90%, forming a catalyst pellet/extrudate is limited.

In embodiments, the framework substitution may be accomplished by a post-modification process in which the zeolite is subjected to dealumination followed by insertion of transition metals, such as Ti and/or Zr and/or Hf. As a result, a zeolite that has been framework-substituted with titanium and/or zirconium and/or hafnium may have a greater silica-to-alumina molar ratio (hereinafter "SAR") relative to the unsubstituted zeolite. Without intending to be bound by any particular theory, it is believed that this post-modification generates mesoporosity which, as used herein, refers to having pores with diameters from 2 nm to 50 nm, which imbues the zeolite with the ability to accept large molecules inside the pores. Also, this post-modification process is believed to increase the number of medium-strength acid sites while decreasing the number of strong acid sites.

A Y-type zeolite may be formed by any method. An exemplary, non-limiting, method follows. An alumina solution is prepared by combining sodium hydroxide with aluminum powder in water. Similarly, a silica solution is prepared by combining sodium hydroxide with colloidal silica. The alumina solution is added to the silica solution while mixing in an ice bath and then held at room temperature for at least 24 hours.

A detailed method of preparing the FS-USY zeolite from the Y-type zeolite is provided in U.S. Pat. No. 10,293,332, the entire content of which is incorporated herein by reference. Briefly, a Y-type zeolite synthesized by a common method is subjected to exchange of sodium ions with ammonium ions by a conventional method to provide a USY zeolite. For example, a Y-type zeolite is dispersed in water to prepare a suspension and ammonium sulfate is added thereto. The solid matter is washed with water and then with an ammonium sulfate aqueous solution at a temperature of 40° C. to 80° C. Then, the product is again washed with water at a temperature of 40° C. to 95° C. and dried at a temperature of 100° C. to 180° C. for 30 minutes to obtain an ammonium-exchanged Y-type zeolite. Subsequently, a hydrogen type Y-type zeolite is prepared by calcining the above ammonium-exchanged Y-type zeolite at 500° C. to 800° C. for 10 minutes to 10 hours in a saturated vapor atmosphere. Iterations of this process increase the amount of ammonium contained on the Y-type zeolite. In this respect, the final ammonium ion exchange rate may be 90% or more.

To provide a FS-USY zeolite, the USY zeolite prepared as above is first calcined at 500° C. to 700° C., for instance at 550° C. to 650° C., for 30 minutes to 10 hours. If the calcining temperature of the USY zeolite is lower than 500° C., a lower quantity of zirconium atoms and/or titanium atoms and/or hafnium tends to be incorporated when carrying out framework substitution treatment in subsequent steps relative to processes where calcining is carried out at 500° C. to 700° C. However, if the calcining temperature exceeds 700° C., the specific surface area of the USY zeolite may be lowered, and a lower quantity of zirconium atoms and/or titanium atoms and/or hafnium atoms tends to be incorporated when carrying out framework substitution treatment in subsequent steps relative to processes where calcining is carried out at 500° C. to 700° C. Calcining may take place in various atmospheres including, but not limited to, air.

The calcined USY zeolite may then be suspended in water having a temperature of about 20° C. to about 30° C. to form a USY zeolite suspension. The liquid/solid mass ratio for this suspension may be in the range of 5 to 15. For example, the liquid/solid mass ratio may be 8 to 12.

Next, an inorganic acid or an organic acid may be added to the suspension to give an acidified USY zeolite suspension. Exemplary acids include, but are not limited to, sulfuric acid, nitric acid, hydrochloric acid, carboxylic acids, and mixtures of two or more thereof. Advantageously, the acid may be used to adjust the pH of the suspension to less than 2, e.g. from 1 to 2. It has been observed that a pH in the above range may prevent precipitation upon mixing an aqueous solution of the zirconium compound and/or an aqueous solution of the titanium compound and/or an aqueous solution of the hafnium compound with the suspension for the framework substitution treatment discussed further below.

A solution containing a zirconium compound and/or a titanium compound and/or a hafnium compound may be added to the acidified suspension and mixed. The addition of the zirconium compound and/or the titanium compound and/or the hafnium compound may be performed gradually, for instance by dropwise addition. The mixing may take place at room temperature, i.e., from about 25° C. to about 35° C., for from three to five hours. Then, the mixed solution may be neutralized to a pH of 7 to 7.5 by adding a base and dried at 80° C. to 180° C., resulting in the FS-USY zeolite in which zirconium atoms and/or titanium atoms and/or hafnium atoms form a part of the zeolite framework by replacing aluminum atoms that were previously part of the zeolite framework. Exemplary bases include, but are not limited to, aqueous ammonia.

In embodiments, exemplary zirconium compounds include, but are not limited to, zirconium sulfate, zirconium nitrate, zirconium chloride, and combinations of two or more thereof. In embodiments in which zirconium is present, the amount of the zirconium compound added may be from 0.1% to 5% by mass on a zirconium oxide basis with respect to the mass of the USY zeolite used. For example, from 0.2% to 4% by mass zirconium compound may be added. The addition of the zirconium compound in an amount of less than 0.1% by mass fails to achieve the desired USY zeolite properties. The addition of the zirconium compound in an amount exceeding 5% by mass may cause clogging of pores of the zeolite. In embodiments, an aqueous solution of a zirconium compound prepared by dissolving the zirconium compound in water may be used as the zirconium compound.

In embodiments, exemplary titanium compounds include, but are not limited to, titanium sulfate, titanium acetate, titanium chloride, titanium nitrate, titanium lactate, and combinations of two or more thereof. In embodiments in which titanium is present, the amount of titanium compound added may be from 0.1% to 5% by mass on a titanium oxide basis with respect to the mass of the USY zeolite used. For example, from 0.2% to 4% by mass titanium compound may be added. The addition of the titanium compound in an amount of less than 0.1% by mass fails to achieve the desired USY zeolite properties. The addition of the titanium compound in an amount exceeding 5% by mass may cause clogging of pores of the zeolite. In embodiments, an aqueous solution of a titanium compound prepared by dissolving the titanium compound in water may be used as the titanium compound.

In embodiments, exemplary hafnium compounds include, but are not limited to, hafnium chloride, hafnium nitrate, hafnium fluoride, hafnium bromide, hafnium oxalate and the like. In embodiments in which hafnium is present, the amount of hafnium compound added may be from 0.1% to 5% by mass on a hafnium oxide basis with respect to the mass of the USY zeolite used. For example, from 0.2% to 4% by mass hafnium compound may be added. The addition of the hafnium compound in an amount of less than 0.1% by mass fails to achieve the desired USY zeolite properties. The addition of the hafnium compound in an amount exceeding 5% by mass may cause clogging of pores of the zeolite and may also increase the cost of the catalyst significantly. In embodiments, an aqueous solution of a hafnium compound prepared by dissolving the hafnium compound in water is suitably used as the hafnium compound.

Framework substitution may be monitored, for example, by ultraviolet, visible, and near-infrared spectrophotometry (UV-Vis-NIR or UV-vis), Fourier transform infrared spectroscopy (FT-IR), or nuclear magnetic resonance spectrometry (NMR).

In embodiments, the FS-USY zeolite may be independently substituted with from 0.1 wt. % to 5 wt. % zirconium and/or from 0.1 wt. % to 5 wt. % titanium and/or from 0.1 wt. % to 5 wt. % hafnium, calculated on an oxide basis. That is, in embodiments, one or more of the zirconium, titanium, and hafnium, may not be included, although at least one of the zirconium, titanium, and hafnium is included. For instance, the FS-USY zeolite may be substituted with zirconium only, titanium only, hafnium only, both zirconium and titanium, both zirconium and hafnium, both titanium and hafnium, or all three of zirconium, titanium, and hafnium.

In embodiments in which zirconium is present, the FS-USY zeolite may include from 0.1 wt. % to 5 wt. % zirconium, from 0.1 wt. % to 4.5 wt. % zirconium, from 0.1 wt. % to 4 wt. % zirconium, from 0.1 wt. % to 3.5 wt. % zirconium, from 0.1 wt. % to 3 wt. % zirconium, from 0.1 wt. % to 2.5 wt. % zirconium, from 0.1 wt. % to 2 wt. % zirconium, from 0.1 wt. % to 1.5 wt. % zirconium, from 0.1 wt. % to 1 wt. % zirconium, from 0.1 wt. % to 0.5 wt. % zirconium, from 0.5 wt. % to 5 wt. % zirconium, from 0.5 wt. % to 4.5 wt. % zirconium, from 0.5 wt. % to 4 wt. % zirconium, from 0.5 wt. % to 3.5 wt. % zirconium, from 0.5 wt. % to 3 wt. % zirconium, from 0.5 wt. % to 2.5 wt. % zirconium, from 0.5 wt. % to 2 wt. % zirconium, from 0.5 wt. % to 1.5 wt. % zirconium, from 0.5 wt. % to 1 wt. % zirconium, from 1 wt. % to 5 wt. % zirconium, from 1 wt.

% to 4.5 wt. % zirconium, from 1 wt. % to 4 wt. % zirconium, from 1 wt. % to 3.5 wt. % zirconium, from 1 wt. % to 3 wt. % zirconium, from 1 wt. % to 2.5 wt. % zirconium, from 1 wt. % to 2 wt. % zirconium, from 1 wt. % to 1.5 wt. % zirconium, from 1.5 wt. % to 5 wt. % zirconium, from 2 wt. % to 5 wt. % zirconium, from 2.5 wt. % to 5 wt. % zirconium, from 3 wt. % to 5 wt. % zirconium, from 3.5 wt. % to 5 wt. % zirconium, from 4 wt. % to 5 wt. % zirconium, or even from 4.5 wt. % to 5 wt. % zirconium.

In embodiments in which titanium is present, the FS-USY zeolite may be substituted with from 0.1 wt. % to 5 wt. % titanium, from 0.1 wt. % to 4.5 wt. % titanium, from 0.1 wt. % to 4 wt. % titanium, from 0.1 wt. % to 3.5 wt. % titanium, from 0.1 wt. % to 3 wt. % titanium, from 0.1 wt. % to 2.5 wt. % titanium, from 0.1 wt. % to 2 wt. % titanium, from 0.1 wt. % to 1.5 wt. % titanium, from 0.1 wt. % to 1 wt. % titanium, from 0.1 wt. % to 0.5 wt. % titanium, from 0.5 wt. % to 5 wt. % titanium, from 0.5 wt. % to 4.5 wt. % titanium, from 0.5 wt. % to 4 wt. % titanium, from 0.5 wt. % to 3.5 wt. % titanium, from 0.5 wt. % to 3 wt. % titanium, from 0.5 wt. % to 2.5 wt. % titanium, from 0.5 wt. % to 2 wt. % titanium, from 0.5 wt. % to 1.5 wt. % titanium, from 0.5 wt. % to 1 wt. % titanium, from 1 wt. % to 5 wt. % titanium, from 1 wt. % to 4.5 wt. % titanium, from 1 wt. % to 4 wt. % titanium, from 1 wt. % to 3.5 wt. % titanium, from 1 wt. % to 3 wt. % titanium, from 1 wt. % to 2.5 wt. % titanium, from 1 wt. % to 2 wt. % titanium, from 1 wt. % to 1.5 wt. % titanium, from 1.5 wt. % to 5 wt. % titanium, from 2 wt. % to 5 wt. % titanium, from 2.5 wt. % to 5 wt. % titanium, from 3 wt. % to 5 wt. % titanium, from 3.5 wt. % to 5 wt. % titanium, from 4 wt. % to 5 wt. % titanium, or even from 4.5 wt. % to 5 wt. % titanium.

In embodiments in which hafnium is present, the FS-USY zeolite may be substituted with from 0.1 wt. % to 5 wt. % hafnium, from 0.1 wt. % to 4.5 wt. % hafnium, from 0.1 wt. % to 4 wt. % hafnium, from 0.1 wt. % to 3.5 wt. % hafnium, from 0.1 wt. % to 3 wt. % hafnium, from 0.1 wt. % to 2.5 wt. % hafnium, from 0.1 wt. % to 2 wt. % hafnium, from 0.1 wt. % to 1.5 wt. % hafnium, from 0.1 wt. % to 1 wt. % hafnium, from 0.1 wt. % to 0.5 wt. % hafnium, from 0.5 wt. % to 5 wt. % hafnium, from 0.5 wt. % to 4.5 wt. % hafnium, from 0.5 wt. % to 4 wt. % hafnium, from 0.5 wt. % to 3.5 wt. % hafnium, from 0.5 wt. % to 3 wt. % hafnium, from 0.5 wt. % to 2.5 wt. % hafnium, from 0.5 wt. % to 2 wt. % hafnium, from 0.5 wt. % to 1.5 wt. % hafnium, from 0.5 wt. % to 1 wt. % hafnium, from 1 wt. % to 5 wt. % hafnium, from 1 wt. % to 4.5 wt. % hafnium, from 1 wt. % to 4 wt. % hafnium, from 1 wt. % to 3.5 wt. % hafnium, from 1 wt. % to 3 wt. % hafnium, from 1 wt. % to 2.5 wt. % hafnium, from 1 wt. % to 2 wt. % hafnium, from 1 wt. % to 1.5 wt. % hafnium, from 1.5 wt. % to 5 wt. % hafnium, from 2 wt. % to 5 wt. % hafnium, from 2.5 wt. % to 5 wt. % hafnium, from 3 wt. % to 5 wt. % hafnium, from 3.5 wt. % to 5 wt. % hafnium, from 4 wt. % to 5 wt. % hafnium, or even from 4.5 wt. % to 5 wt. % hafnium.

It should be understood that any amount of zirconium-substitution described herein can be used in conjunction with any amount of titanium-substitution described herein and any amount of hafnium substitution described herein, including in an amount of 0 wt. % of any one or two of zirconium, titanium, and hafnium. Further, it should be understood that the range of zirconium substitution or titanium substitution or hafnium substitution may be formed from any of the lower bounds of such substitution described herein and any of the upper bounds of such substitution described herein.

Without intending to be bound by any particular theory, it is believed the addition of the zirconium compound and/or the titanium compound and/or the hafnium compound at an amount of less than 0.1 wt. % fails to improve the solid acid properties of the zeolite. Conversely, the addition of the zirconium compound and/or the titanium compound and/or the hafnium compound in an amount exceeding 5 wt. % does not improve the zeolite activity further and may create an unnecessary increase in cost of the resulting catalyst.

In embodiments, the FS-USY zeolite may have a crystal lattice constant from 2.42 nm to 2.45 nm. For example, the crystal lattice constant of the FS-USY zeolite may be from 2.42 nm to 2.449 nm, from 2.42 nm to 2.448 nm, from 2.42 nm to 2.447 nm, from 2.42 nm to 2.446 nm, from 2.42 nm to 2.445 nm, from 2.42 nm to 2.444 nm, from 2.42 nm to 2.443 nm, from 2.42 nm to 2.442 nm, from 2.42 nm to 2.441 nm, from 2.42 nm to 2.44 nm, from 2.42 nm to 2.439 nm, from 2.42 nm to 2.438 nm, from 2.42 nm to 2.437 nm, from 2.42 nm to 2.436 nm, from 2.42 nm to 2.435 nm, from 2.42 nm to 2.434 nm, from 2.42 nm to 2.433 nm, from 2.42 nm to 2.432 nm, from 2.42 nm to 2.431 nm, from 2.42 nm to 2.43 nm, from 2.42 nm to 2.429 nm, from 2.42 nm to 2.428 nm, from 2.42 nm to 2.427 nm, from 2.42 nm to 2.426 nm, from 2.42 nm to 2.425 nm, from 2.42 nm to 2.424 nm, from 2.42 nm to 2.423 nm, from 2.42 nm to 2.422 nm, from 2.42 nm to 2.421 nm, from 2.421 nm to 2.45 nm, from 2.422 nm to 2.45 nm, from 2.423 nm to 2.45 nm, from 2.424 nm to 2.45 nm, from 2.425 nm to 2.45 nm, from 2.426 nm to 2.45 nm, from 2.427 nm to 2.45 nm, from 2.428 nm to 2.45 nm, from 2.429 nm to 2.45 nm, from 2.43 nm to 2.45 nm, from 2.431 nm to 2.45 nm, from 2.432 nm to 2.45 nm, from 2.433 nm to 2.45 nm, from 2.434 nm to 2.45 nm, from 2.435 nm to 2.45 nm, from 2.436 nm to 2.45 nm, from 2.437 nm to 2.45 nm, from 2.438 nm to 2.45 nm, from 2.439 nm to 2.45 nm, from 2.44 nm to 2.45 nm, from 2.441 nm to 2.45 nm, from 2.442 nm to 2.45 nm, from 2.443 nm to 2.45 nm, from 2.444 nm to 2.45 nm, from 2.445 nm to 2.45 nm, from 2.446 nm to 2.45 nm, from 2.447 nm to 2.45 nm, from 2.448 nm to 2.45 nm, or even from 2.449 nm to 2.45 nm. It should be understood that the crystal lattice constant of the FS-USY zeolite may be in a range formed from any one of the lower bounds for such crystal lattice constant described herein to any one of the upper bounds for such crystal lattice constant described herein.

Without intending to be bound by any particular theory, it is believed that a crystal lattice constant for the FS-USY zeolite of less than 2.42 nm may result in a reduction in the activity of the ultimately formed hydrodearylation catalyst. Such reduction is believed to be the result of a high $SiO_2/Al_2O_3$ molar ratio in the framework structure of the USY zeolite and a small number of solid acid sites serving as active sites for the decomposition of hydrocarbons. Conversely, a crystal lattice constant for the FS-USY zeolite exceeding 2.45 nm may result in breakage of the crystal structure of the FS-USY zeolite during a hydrodearylation reaction because of a low heat resistance of the FS-USY zeolite. The breakage of the crystal structure of the FS-USY zeolite may result in a reduction in the activity of the ultimately formed hydrodearylation catalyst composition.

In embodiments, the FS-USY zeolite may have a specific surface area from 600 $m^2/g$ to 900 $m^2/g$. For example, the specific surface area of the FS-USY may be from 600 $m^2/g$ to 890 $m^2/g$, from 600 $m^2/g$ to 880 $m^2/g$, from 600 $m^2/g$ to 870 $m^2/g$, from 600 $m^2/g$ to 860 $m^2/g$, from 600 $m^2/g$ to 850 $m^2/g$, from 600 $m^2/g$ to 840 $m^2/g$, from 600 $m^2/g$ to 830 $m^2/g$, from 600 $m^2/g$ to 820 $m^2/g$, from 600 $m^2/g$ to 810 $m^2/g$, from 600 $m^2/g$ to 800 $m^2/g$, from 600 $m^2/g$ to 790

$m^2/g$, from 600 $m^2/g$ to 780 $m^2/g$, from 600 $m^2/g$ to 770 $m^2/g$, from 600 $m^2/g$ to 760 $m^2/g$, from 600 $m^2/g$ to 750 $m^2/g$, from 600 $m^2/g$ to 740 $m^2/g$, from 600 $m^2/g$ to 730 $m^2/g$, from 600 $m^2/g$ to 720 $m^2/g$, from 600 $m^2/g$ to 710 $m^2/g$, from 600 $m^2/g$ to 700 $m^2/g$, from 600 $m^2/g$ to 690 $m^2/g$, from 600 $m^2/g$ to 680 $m^2/g$, from 600 $m^2/g$ to 670 $m^2/g$, from 600 $m^2/g$ to 660 $m^2/g$, from 600 $m^2/g$ to 650 $m^2/g$, from 600 $m^2/g$ to 640 $m^2/g$, from 600 $m^2/g$ to 630 $m^2/g$, from 600 $m^2/g$ to 620 $m^2/g$, from 600 $m^2/g$ to 610 $m^2/g$, from 610 $m^2/g$ to 900 $m^2/g$, from 620 $m^2/g$ to 900 $m^2/g$, from 630 $m^2/g$ to 900 $m^2/g$, from 640 $m^2/g$ to 900 $m^2/g$, from 650 $m^2/g$ to 900 $m^2/g$, from 660 $m^2/g$ to 900 $m^2/g$, from 670 $m^2/g$ to 900 $m^2/g$, from 680 $m^2/g$ to 900 $m^2/g$, from 690 $m^2/g$ to 900 $m^2/g$, from 700 $m^2/g$ to 900 $m^2/g$, from 710 $m^2/g$ to 900 $m^2/g$, from 720 $m^2/g$ to 900 $m^2/g$, from 730 $m^2/g$ to 900 $m^2/g$, from 740 $m^2/g$ to 900 $m^2/g$, from 750 $m^2/g$ to 900 $m^2/g$, from 760 $m^2/g$ to 900 $m^2/g$, from 770 $m^2/g$ to 900 $m^2/g$, from 780 $m^2/g$ to 900 $m^2/g$, from 790 $m^2/g$ to 900 $m^2/g$, from 800 $m^2/g$ to 900 $m^2/g$, from 810 $m^2/g$ to 900 $m^2/g$, from 820 $m^2/g$ to 900 $m^2/g$, from 830 $m^2/g$ to 900 $m^2/g$, from 840 $m^2/g$ to 900 $m^2/g$, from 850 $m^2/g$ to 900 $m^2/g$, from 860 $m^2/g$ to 900 $m^2/g$, from 870 $m^2/g$ to 900 $m^2/g$, from 880 $m^2/g$ to 900 $m^2/g$, or even from 890 $m^2/g$ to 900 $m^2/g$. It should be understood that the specific surface area of the FS-USY zeolite may be in a range formed from any one of the lower bounds for such specific surface area described herein to any one of the upper bounds for such specific surface area described herein. Without intending to be bound by any particular theory, it is believed that a specific surface area of the FS-USY zeolite of less than 600 $m^2/g$ may result in a reduction in the number of available solid acid sites, thereby reducing the catalyst activity of the resulting hydrodearylation catalyst composition to an unsatisfactory level.

In embodiments, the catalyst composition comprising the FS-USY zeolite may have a specific surface area from 200 $m^2/g$ to 500 $m^2/g$. For example, the specific surface area of the catalyst composition comprising the FS-USY zeolite may be from 200 $m^2/g$ to 490 $m^2/g$, from 200 $m^2/g$ to 480 $m^2/g$, from 200 $m^2/g$ to 470 $m^2/g$, from 200 $m^2/g$ to 460 $m^2/g$, from 200 $m^2/g$ to 450 $m^2/g$, from 200 $m^2/g$ to 440 $m^2/g$, from 200 $m^2/g$ to 430 $m^2/g$, from 200 $m^2/g$ to 420 $m^2/g$, from 200 $m^2/g$ to 410 $m^2/g$, from 200 $m^2/g$ to 400 $m^2/g$, from 200 $m^2/g$ to 390 $m^2/g$, from 200 $m^2/g$ to 380 $m^2/g$, from 200 $m^2/g$ to 370 $m^2/g$, from 200 $m^2/g$ to 360 $m^2/g$, from 200 $m^2/g$ to 350 $m^2/g$, from 200 $m^2/g$ to 340 $m^2/g$, from 200 $m^2/g$ to 330 $m^2/g$, from 200 $m^2/g$ to 320 $m^2/g$, from 200 $m^2/g$ to 310 $m^2/g$, from 200 $m^2/g$ to 300 $m^2/g$, from 200 $m^2/g$ to 290 $m^2/g$, from 200 $m^2/g$ to 280 $m^2/g$, from 200 $m^2/g$ to 270 $m^2/g$, from 200 $m^2/g$ to 260 $m^2/g$, from 200 $m^2/g$ to 250 $m^2/g$, from 200 $m^2/g$ to 240 $m^2/g$, from 200 $m^2/g$ to 230 $m^2/g$, from 200 $m^2/g$ to 220 $m^2/g$, from 200 $m^2/g$ to 210 $m^2/g$, from 210 $m^2/g$ to 500 $m^2/g$, from 220 $m^2/g$ to 500 $m^2/g$, from 230 $m^2/g$ to 500 $m^2/g$, from 240 $m^2/g$ to 500 $m^2/g$, from 250 $m^2/g$ to 500 $m^2/g$, from 260 $m^2/g$ to 500 $m^2/g$, from 270 $m^2/g$ to 500 $m^2/g$, from 280 $m^2/g$ to 500 $m^2/g$, from 290 $m^2/g$ to 500 $m^2/g$, from 300 $m^2/g$ to 500 $m^2/g$, from 310 $m^2/g$ to 500 $m^2/g$, from 320 $m^2/g$ to 500 $m^2/g$, from 330 $m^2/g$ to 500 $m^2/g$, from 340 $m^2/g$ to 500 $m^2/g$, from 350 $m^2/g$ to 500 $m^2/g$, from 360 $m^2/g$ to 500 $m^2/g$, from 370 $m^2/g$ to 500 $m^2/g$, from 380 $m^2/g$ to 500 $m^2/g$, from 390 $m^2/g$ to 500 $m^2/g$, from 400 $m^2/g$ to 500 $m^2/g$, from 410 $m^2/g$ to 500 $m^2/g$, from 420 $m^2/g$ to 500 $m^2/g$, from 430 $m^2/g$ to 500 $m^2/g$, from 440 $m^2/g$ to 500 $m^2/g$, from 450 $m^2/g$ to 500 $m^2/g$, from 460 $m^2/g$ to 500 $m^2/g$, from 470 $m^2/g$ to 500 $m^2/g$, from 480 $m^2/g$ to 500 $m^2/g$, or even from 490 $m^2/g$ to 500 $m^2/g$. It should be understood that the specific surface area of the catalyst composition comprising the FS-USY zeolite may be in a range formed from any one of the lower bounds for such specific surface area described herein to any one of the upper bounds for such specific surface area described herein. Without intending to be bound by any particular theory, it is believed that the hydrodearylation rate is reduced when the specific surface area is less than 200 $m^2/g$.

In embodiments, the FS-USY zeolite may have a molar ratio of $SiO_2$ to $Al_2O_3$ from 12 to 100. For example, the FS-USY zeolite may have a molar ratio of $SiO_2$ to $Al_2O_3$ from 12 to 99, from 12 to 98, from 12 to 97, from 12 to 96, from 12 to 95, from 12 to 94, from 12 to 93, from 12 to 92, from 12 to 91, from 12 to 90, from 12 to 89, from 12 to 88, from 12 to 87, from 12 to 86, from 12 to 85, from 12 to 84, from 12 to 83, from 12 to 82, from 12 to 81, from 12 to 80, from 12 to 79, from 12 to 78, from 12 to 77, from 12 to 76, from 12 to 75, from 12 to 74, from 12 to 73, from 12 to 72, from 12 to 71, from 12 to 70, from 12 to 69, from 12 to 68, from 12 to 67, from 12 to 66, from 12 to 65, from 12 to 64, from 12 to 63, from 12 to 62, from 12 to 61, from 12 to 60, from 12 to 59, from 12 to 58, from 12 to 57, from 12 to 56, from 12 to 55, from 12 to 54, from 12 to 53, from 12 to 52, from 12 to 51, from 12 to 50, from 12 to 49, from 12 to 48, from 12 to 47, from 12 to 46, from 12 to 45, from 12 to 44, from 12 to 43, from 12 to 42, from 12 to 41, from 12 to 40, from 12 to 39, from 12 to 38, from 12 to 37, from 12 to 36, from 12 to 35, from 12 to 34, from 12 to 33, from 12 to 32, from 12 to 31, from 12 to 30, from 12 to 29, from 12 to 28, from 12 to 27, from 12 to 26, from 12 to 25, from 12 to 24, from 12 to 23, from 12 to 22, from 12 to 21, from 12 to 20, from 12 to 19, from 12 to 18, from 12 to 17, from 12 to 16, from 12 to 15, from 12 to 14, from 12 to 13, from 13 to 100, from 14 to 100, from 15 to 100, from 16 to 100, from 17 to 100, from 18 to 100, from 19 to 100, from 20 to 100, from 21 to 100, from 22 to 100, from 23 to 100, from 24 to 100, from 25 to 100, from 26 to 100, from 27 to 100, from 28 to 100, from 29 to 100, from 30 to 100, from 31 to 100, from 32 to 100, from 33 to 100, from 34 to 100, from 35 to 100, from 36 to 100, from 37 to 100, from 38 to 100, from 39 to 100, from 40 to 100, from 41 to 100, from 42 to 100, from 43 to 100, from 44 to 100, from 45 to 100, from 46 to 100, from 47 to 100, from 48 to 100, from 49 to 100, from 50 to 100, from 51 to 100, from 52 to 100, from 53 to 100, from 54 to 100, from 55 to 100, from 56 to 100, from 57 to 100, from 58 to 100, from 59 to 100, from 60 to 100, from 61 to 100, from 62 to 100, from 63 to 100, from 64 to 100, from 65 to 100, from 66 to 100, from 67 to 100, from 68 to 100, from 69 to 100, from 70 to 100, from 71 to 100, from 72 to 100, from 73 to 100, from 74 to 100, from 75 to 100, from 76 to 100, from 77 to 100, from 78 to 100, from 79 to 100, from 80 to 100, from 81 to 100, from 82 to 100, from 83 to 100, from 84 to 100, from 85 to 100, from 86 to 100, from 87 to 100, from 88 to 100, from 89 to 100, from 90 to 100, from 91 to 100, from 92 to 100, from 93 to 100, from 94 to 100, from 95 to 100, from 96 to 100, from 97 to 100, from 98 to 100, or even from 99 to 100. It should be understood that the ratio of $SiO_2$ to $Al_2O_3$ of the FS-USY zeolite may be in a range formed from any one of the lower bounds for such ratio described herein to any one of the upper bounds for such ratio described herein.

Without intending to be bound by any particular theory, it is believed that a larger alumina content is associated with lower stability of the FS-USY. Conversely, a silica-alumina ratio of the FS-USY zeolite exceeding 100 may result in a reduction in hydrodearylation activity in a decomposition reactor of the ultimately prepared hydrodearylation catalyst because of a small number of solid acid sites effective for hydrodearylation.

In embodiments, the catalyst composition comprising the FS-USY zeolite may include a plurality of pores having a diameter of 600 Å or less. These pores having a diameter of 600 Å or less have a volume from 0.4 ml/g to 0.95 ml/g. For example the pore volume may be in the range from 0.4 ml/g to 0.94 ml/g, from 0.4 ml/g to 0.93 ml/g, from 0.4 ml/g to 0.92 ml/g, from 0.4 ml/g to 0.91 ml/g, from 0.4 ml/g to 0.9 ml/g, from 0.4 ml/g to 0.89 ml/g, from 0.4 ml/g to 0.88 ml/g, from 0.4 ml/g to 0.87 ml/g, from 0.4 ml/g to 0.86 ml/g, from 0.4 ml/g to 0.85 ml/g, from 0.4 ml/g to 0.84 ml/g, from 0.4 ml/g to 0.83 ml/g, from 0.4 ml/g to 0.82 ml/g, from 0.4 ml/g to 0.81 ml/g, from 0.4 ml/g to 0.7 ml/g, from 0.4 ml/g to 0.79 ml/g, from 0.4 ml/g to 0.78 ml/g, from 0.4 ml/g to 0.77 ml/g, from 0.4 ml/g to 0.76 ml/g, from 0.4 ml/g to 0.75 ml/g, from 0.4 ml/g to 0.74 ml/g, from 0.4 ml/g to 0.73 ml/g, from 0.4 ml/g to 0.72 ml/g, from 0.4 ml/g to 0.71 ml/g, from 0.4 ml/g to 0.7 ml/g, from 0.4 ml/g to 0.69 ml/g, from 0.4 ml/g to 0.68 ml/g, from 0.4 ml/g to 0.67 ml/g, from 0.4 ml/g to 0.66 ml/g, from 0.4 ml/g to 0.65 ml/g, from 0.4 ml/g to 0.64 ml/g, from 0.4 ml/g to 0.63 ml/g, from 0.4 ml/g to 0.62 ml/g, from 0.4 ml/g to 0.61 ml/g, from 0.4 ml/g to 0.6 ml/g, from 0.4 ml/g to 0.59 ml/g, from 0.4 ml/g to 0.58 ml/g, from 0.4 ml/g to 0.57 ml/g, from 0.4 ml/g to 0.56 ml/g, from 0.4 ml/g to 0.55 ml/g, from 0.4 ml/g to 0.54 ml/g, from 0.4 ml/g to 0.53 ml/g, from 0.4 ml/g to 0.52 ml/g, from 0.4 ml/g to 0.51 ml/g, from 0.4 ml/g to 0.5 ml/g, from 0.4 ml/g to 0.49 ml/g, from 0.4 ml/g to 0.48 ml/g, from 0.4 ml/g to 0.47 ml/g, from 0.4 ml/g to 0.46 ml/g, from 0.4 ml/g to 0.45 ml/g, from 0.4 ml/g to 0.44 ml/g, from 0.4 ml/g to 0.43 ml/g, from 0.4 ml/g to 0.42 ml/g, from 0.4 ml/g to 0.41 ml/g, from 0.41 ml/g to 0.95 ml/g, from 0.42 ml/g to 0.95 ml/g, from 0.43 ml/g to 0.95 ml/g, from 0.44 ml/g to 0.95 ml/g, from 0.45 ml/g to 0.95 ml/g, from 0.46 ml/g to 0.95 ml/g, from 0.47 ml/g to 0.95 ml/g, from 0.48 ml/g to 0.95 ml/g, from 0.49 ml/g to 0.95 ml/g, from 0.5 ml/g to 0.95 ml/g, from 0.51 ml/g to 0.95 ml/g, from 0.52 ml/g to 0.95 ml/g, from 0.53 ml/g to 0.95 ml/g, from 0.54 ml/g to 0.95 ml/g, from 0.55 ml/g to 0.95 ml/g, from 0.56 ml/g to 0.95 ml/g, from 0.57 ml/g to 0.95 ml/g, from 0.58 ml/g to 0.95 ml/g, from 0.59 ml/g to 0.95 ml/g, from 0.6 ml/g to 0.95 ml/g, from 0.61 ml/g to 0.95 ml/g, from 0.62 ml/g to 0.95 ml/g, from 0.63 ml/g to 0.95 ml/g, from 0.64 ml/g to 0.95 ml/g, from 0.65 ml/g to 0.95 ml/g, from 0.66 ml/g to 0.95 ml/g, from 0.67 ml/g to 0.95 ml/g, from 0.68 ml/g to 0.95 ml/g, from 0.69 ml/g to 0.95 ml/g, from 0.7 ml/g to 0.95 ml/g, from 0.71 ml/g to 0.95 ml/g, from 0.72 ml/g to 0.95 ml/g, from 0.73 ml/g to 0.95 ml/g, from 0.74 ml/g to 0.95 ml/g, from 0.75 ml/g to 0.95 ml/g, from 0.76 ml/g to 0.95 ml/g, from 0.77 ml/g to 0.95 ml/g, from 0.78 ml/g to 0.95 ml/g, from 0.79 ml/g to 0.95 ml/g, from 0.8 ml/g to 0.95 ml/g, from 0.81 ml/g to 0.95 ml/g, from 0.82 ml/g to 0.95 ml/g, from 0.83 ml/g to 0.95 ml/g, from 0.84 ml/g to 0.95 ml/g, from 0.85 ml/g to 0.95 ml/g, from 0.86 ml/g to 0.95 ml/g, from 0.87 ml/g to 0.95 ml/g, from 0.88 ml/g to 0.95 ml/g, from 0.89 ml/g to 0.95 ml/g, from 0.9 ml/g to 0.95 ml/g, from 0.91 ml/g to 0.95 ml/g, from 0.92 ml/g to 0.95 ml/g, from 0.93 ml/g to 0.95 ml/g, or even from 0.94 ml/g to 0.95 ml/g. It should be understood that the pore volume of pores of the catalyst composition comprising the FS-USY zeolite having a diameter of 600 Å or less may be in a range formed from any one of the lower bounds for such pore volume described herein to any one of the upper bounds for such pore volume described herein.

Without intending to be bound by any particular theory, it is believed that the specific surface area is reduced if the pore volume is less than 0.40 ml/g. As a result, the hydrodearylation catalyst activity is reduced.

In embodiments, the catalyst composition may include other additives. For instance, the catalyst composition may include one or more inorganic oxides in addition to the zeolite described above. The inorganic oxide may act as a granulating agent or a binder. Exemplary inorganic oxides include, but are not limited to, alumina, silica, titania, silica-alumina, alumina-titania, alumina-zirconia, alumina-boria, phosphorus-alumina, silica-alumina-boria, phosphorus-alumina-boria, phosphorus-alumina-silica, silica-alumina-titania, and silica-alumina-zirconia.

In embodiments, the one or more inorganic oxides may be a component of the catalyst support. In embodiments having both a FS-USY zeolite and an inorganic oxide, the FS-USY zeolite present may comprise from 1 wt. % to 90 wt. %, from 1 wt. % to 85 wt. %, from 1 wt. % to 80 wt. %, from 10 wt. % to 75 wt. %, from 20 wt. % to 70 wt. %, or even from 30 wt. % to 60 wt. % of the support. In such embodiments, the inorganic oxide content may comprise from 99 wt. % to 10 wt. %, from 99 wt. % to 15 wt. %, from 99 wt. % to 20 wt. %, from 90 wt. % to 25 wt. %, from 80 wt. % to 30 wt. %, or even from 70 wt. % to 40 wt. % of the support. It should be understood that the FS-USY zeolite may be present in a range formed from any one of the lower bounds for such concentration described herein to any one of the upper bounds for such concentration described herein. It should be further understood that the inorganic oxide may be present in a range formed from any one of the lower bounds for such concentration described herein to any one of the upper bounds for such concentration described herein. Without intending to be bound by any particular theory, it is believed that the catalyst may not have sufficient mechanical strength if the inorganic oxide content falls below 10 wt. %. Further, it is believed that the catalyst may not have sufficient cracking capabilities if the zeolite content falls below 1 wt. %.

The catalyst composition does not contain a hydrogenative metal component disposed on the support. Without intending to be bound by any particular theory, it is believed that a hydrogenative metal component would aid in the hydrogenation of aromatic compounds under the hydrodearylation conditions. Therefore, when a hydrogenative metal component is present, the overall yield of desired aromatic compounds from the hydrodearylation would be diminished.

As noted above, the method for hydrodearylating aromatic bottoms oil includes contacting at least one aromatic bottoms oil stream with the catalyst composition and hydrogen in a reactor. The reactor may operate within a temperature range from 250° C. to 400° C. For example, the reactor may operate within a temperature range from 250° C. to 390° C., from 250° C. to 380° C., from 250° C. to 370° C., from 250° C. to 360° C., from 250° C. to 350° C., from 250° C. to 340° C., from 250° C. to 330° C., from 250° C. to 320° C., from 250° C. to 310° C., from 250° C. to 300° C., from 250° C. to 290° C., from 250° C. to 280° C., from 250° C. to 270° C., from 250° C. to 260° C., from 260° C. to 400° C., from 270° C. to 400° C., from 280° C. to 400° C., from 290° C. to 400° C., from 300° C. to 400° C., from 310° C. to 400° C., from 320° C. to 400° C., from 330° C. to 400° C., from 340° C. to 400° C., from 350° C. to 400° C., from 360° C. to 400° C., from 370° C. to 400° C., from 380° C. to 400° C., or even from 390° C. to 400° C. It should be understood that the reactor may operate within a temperature range formed from any one of the lower bounds of such temperature described herein and any one of the upper bounds of such temperature described herein.

The aromatic bottoms oil may have a boiling point from 150° C. to 450° C. For example, the aromatic bottoms oil may have a boiling point from 150° C. to 400° C., from 150° C. to 350° C., from 150° C. to 300° C., from 150° C. to 250° C., from 150° C. to 200° C., from 200° C. to 450° C., from 250° C. to 450° C., from 300° C. to 450° C., from 350° C. to 450° C., or even from 400° C. to 450° C. It should be understood that the aromatic bottoms oil may have a boiling point within a temperature range formed from any one of the lower bounds of such temperature described herein and any one of the upper bounds of such temperature described herein.

Hydrogen may be used to cleave the alkyl bridge of non-condensed alkyl-bridged multi-aromatics or heavy alkyl aromatic compounds during the hydrodearylation process. The hydrogen may be added to the reactor at a pressure from 0.5 MPa to 10 MPa. For example, the hydrogen may be added to the reactor at a pressure from 0.5 MPa to 9.5 MPa, from 0.5 MPa to 9 MPa, from 0.5 MPa to 8.5 MPa, from 0.5 MPa to 8 MPa, from 0.5 MPa to 7.5 MPa, from 0.5 MPa to 7 MPa, from 0.5 MPa to 6.5 MPa, from 0.5 MPa to 6 MPa, from 0.5 MPa to 5.5 MPa, from 0.5 MPa to 5 MPa, from 0.5 MPa to 4.5 MPa, from 0.5 MPa to 4 MPa, from 0.5 MPa to 3.5 MPa, from 0.5 MPa to 3 MPa, from 0.5 MPa to 2.5 MPa, from 0.5 MPa to 2 MPa, from 0.5 MPa to 1.5 MPa, from 0.5 MPa to 1 MPa, from 1 MPa to 10 MPa, from 1.5 MPa to 10 MPa, from 2 MPa to 10 MPa, from 2.5 MPa to 10 MPa, from 3 MPa to 10 MPa, from 3.5 MPa to 10 MPa, from 4 MPa to 10 MPa, from 4.5 MPa to 10 MPa, from 5 MPa to 10 MPa, from 5.5 MPa to 10 MPa, from 6 MPa to 10 MPa, from 6.5 MPa to 10 MPa, from 7 MPa to 10 MPa, from 7.5 MPa to 10 MPa, from 8 MPa to 10 MPa, from 8.5 MPa to 10 MPa, from 9 MPa to 10 MPa, or even from 9.5 MPa to 10 MPa. It should be understood that the hydrogen may be added to the reactor in a range of pressure from any one of the lower bounds of such pressure described herein to any one of the upper bounds of such pressure described herein. Without intending to be bound by any particular theory, it is believed that the process performance will be significantly reduced at lower hydrogen pressure. Conversely, it is believed that processes using high hydrogen pressure require specialized equipment that may significantly increase the cost of the process.

The hydrogen feed and aromatic bottoms oil feeds may be adjusted such that the hydrogen/oil ratio in the reactor may be from 50 normal cubic meters per cubic meter (hereinafter "$Nm^3/m^3$") to 2000 $Nm^3/m^3$, with normal cubic meters being defined as the volume in cubic meters at standard temperature and pressure (15° C. and 0.1 MPa). For example, the hydrogen/oil ratio may be from 50 $Nm^3/m^3$ to 1950 $Nm^3/m^3$, from 50 $Nm^3/m^3$ to 1900 $Nm^3/m^3$, from 50 $Nm^3/m^3$ to 1850 $Nm^3/m^3$, from 50 $Nm^3/m^3$ to 1800 $Nm^3/m^3$, from 50 $Nm^3/m^3$ to 1750 $Nm^3/m^3$, from 50 $Nm^3/m^3$ to 1700 $Nm^3/m^3$, from 50 $Nm^3/m^3$ to 1650 $Nm^3/m^3$, from 50 $Nm^3/m^3$ to 1600 $Nm^3/m^3$, from 50 $Nm^3/m^3$ to 1550 $Nm^3/m^3$, from 50 $Nm^3/m^3$ to 1500 $Nm^3/m^3$, from 50 $Nm^3/m^3$ to 1450 $Nm^3/m^3$, from 50 $Nm^3/m^3$ to 1400 $Nm^3/m^3$, from 50 $Nm^3/m^3$ to 1350 $Nm^3/m^3$, from 50 $Nm^3/m^3$ to 1300 $Nm^3/m^3$, from 50 $Nm^3/m^3$ to 1250 $Nm^3/m^3$, from 50 $Nm^3/m^3$ to 1200 $Nm^3/m^3$, from 50 $Nm^3/m^3$ to 1150 $Nm^3/m^3$, from 50 $Nm^3/m^3$ to 1100 $Nm^3/m^3$, from 50 $Nm^3/m^3$ to 1050 $Nm^3/m^3$, from 50 $Nm^3/m^3$ to 1000 $Nm^3/m^3$, from 50 $Nm^3/m^3$ to 950 $Nm^3/m^3$, from 50 $Nm^3/m^3$ to 900 $Nm^3/m^3$, from 50 $Nm^3/m^3$ to 850 $Nm^3/m^3$, from 50 $Nm^3/m^3$ to 800 $Nm^3/m^3$, from 50 $Nm^3/m^3$ to 750 $Nm^3/m^3$, from 50 $Nm^3/m^3$ to 700 $Nm^3/m^3$, from 50 $Nm^3/m^3$ to 650 $Nm^3/m^3$, from 50 $Nm^3/m^3$ to 600 $Nm^3/m^3$, from 50 $Nm^3/m^3$ to 550 $Nm^3/m^3$, from 50 $Nm^3/m^3$ to 500 $Nm^3/m^3$, from 50 $Nm^3/m^3$ to 450 $Nm^3/m^3$, from 50 $Nm^3/m^3$ to 400 $Nm^3/m^3$, from 50 $Nm^3/m^3$ to 350 $Nm^3/m^3$, from 50 $Nm^3/m^3$ to 300 $Nm^3/m^3$, from 50 $Nm^3/m^3$ to 250 $Nm^3/m^3$, from 50 $Nm^3/m^3$ to 200 $Nm^3/m^3$, from 50 $Nm^3/m^3$ to 150 $Nm^3/m^3$, from 50 $Nm^3/m^3$ to 100 $Nm^3/m^3$, from 100 $Nm^3/m^3$ to 2000 $Nm^3/m^3$, from 150 $Nm^3/m^3$ to 2000 $Nm^3/m^3$, from 200 $Nm^3/m^3$ to 2000 $Nm^3/m^3$, from 250 $Nm^3/m^3$ to 2000 $Nm^3/m^3$, from 300 $Nm^3/m^3$ to 2000 $Nm^3/m^3$, from 350 $Nm^3/m^3$ to 2000 $Nm^3/m^3$, from 400 $Nm^3/m^3$ to 2000 $Nm^3/m^3$, from 450 $Nm^3/m^3$ to 2000 $Nm^3/m^3$, from 500 $Nm^3/m^3$ to 2000 $Nm^3/m^3$, from 550 $Nm^3/m^3$ to 2000 $Nm^3/m^3$, from 600 $Nm^3/m^3$ to 2000 $Nm^3/m^3$, from 650 $Nm^3/m^3$ to 2000 $Nm^3/m^3$, from 700 $Nm^3/m^3$ to 2000 $Nm^3/m^3$, from 750 $Nm^3/m^3$ to 2000 $Nm^3/m^3$, from 800 $Nm^3/m^3$ to 2000 $Nm^3/m^3$, from 850 $Nm^3/m^3$ to 2000 $Nm^3/m^3$, from 900 $Nm^3/m^3$ to 2000 $Nm^3/m^3$, from 950 $Nm^3/m^3$ to 2000 $Nm^3/m^3$, from 1000 $Nm^3/m^3$ to 2000 $Nm^3/m^3$, from 1050 $Nm^3/m^3$ to 2000 $Nm^3/m^3$, from 1100 $Nm^3/m^3$ to 2000 $Nm^3/m^3$, from 1150 $Nm^3/m^3$ to 2000 $Nm^3/m^3$, from 1200 $Nm^3/m^3$ to 2000 $Nm^3/m^3$, from 1250 $Nm^3/m^3$ to 2000 $Nm^3/m^3$, from 1300 $Nm^3/m^3$ to 2000 $Nm^3/m^3$, from 1350 $Nm^3/m^3$ to 2000 $Nm^3/m^3$, from 1400 $Nm^3/m^3$ to 2000 $Nm^3/m^3$, from 1450 $Nm^3/m^3$ to 2000 $Nm^3/m^3$, from 1500 $Nm^3/m^3$ to 2000 $Nm^3/m^3$, from 1550 $Nm^3/m^3$ to 2000 $Nm^3/m^3$, from 1600 $Nm^3/m^3$ to 2000 $Nm^3/m^3$, from 1650 $Nm^3/m^3$ to 2000 $Nm^3/m^3$, from 1700 $Nm^3/m^3$ to 2000 $Nm^3/m^3$, from 1750 $Nm^3/m^3$ to 2000 $Nm^3/m^3$, from 1800 $Nm^3/m^3$ to 2000 $Nm^3/m^3$, from 1850 $Nm^3/m^3$ to 2000 $Nm^3/m^3$, from 1900 $Nm^3/m^3$ to 2000 $Nm^3/m^3$, or even from 1950 $Nm^3/m^3$ to 2000 $Nm^3/m^3$. It should be understood that the hydrogen/oil ratio may be in a range of ratios from any one of the lower bounds of such ratio described herein to any one of the upper bounds of such ratio described herein. Without intending to be bound by any particular theory, it is believed that the process performance will be significantly reduced at a lower hydrogen/oil ratio. Conversely, it is believed that processes using a high hydrogen/oil ratio require specialized equipment that may significantly increase the cost of the process and may increase the gas holdup in the system thereby decreasing process performance.

The liquid hourly space velocity (hereinafter "LHSV") of the aromatic bottoms feed in the reactor may be from 0.1 per hour to 10 per hour. For example, the liquid hourly space velocity may be from 0.1 per hour to 9.5 per hour, from 0.1 per hour to 9 per hour, from 0.1 per hour to 8.5 per hour, from 0.1 per hour to 8 per hour, from 0.1 per hour to 7.5 per hour, from 0.1 per hour to 7 per hour, from 0.1 per hour to 6.5 per hour, from 0.1 per hour to 6 per hour, from 0.1 per hour to 5.5 per hour, from 0.1 per hour to 5 per hour, from 0.1 per hour to 4.5 per hour, from 0.1 per hour to 4 per hour, from 0.1 per hour to 3.5 per hour, from 0.1 per hour to 3 per hour, from 0.1 per hour to 2.5 per hour, from 0.1 per hour to 2 per hour, from 0.1 per hour to 1.5 per hour, from 0.1 per hour to 1 per hour, from 0.1 per hour to 0.5 per hour, from 0.5 per hour to 10 per hour, from 1 per hour to 10 per hour, from 1.5 per hour to 10 per hour, from 2 per hour to 10 per hour, from 2.5 per hour to 10 per hour, from 3 per hour to 10 per hour, from 3.5 per hour to 10 per hour, from 4 per hour to 10 per hour, from 4.5 per hour to 10 per hour, from 5 per hour to 10 per hour, from 5.5 per hour to 10 per hour, from 6 per hour to 10 per hour, from 6.5 per hour to 10 per hour, from 7 per hour to 10 per hour, from 7.5 per hour to 10 per hour, from 8 per hour to 10 per hour, from 8.5 per hour to 10 per hour, from 9 per hour to 10 per hour, or even from 9.5 per hour to 10 per hour. It should be understood that the LHSV may be in a range formed from any one of the lower bounds for the LHSV described herein to any one of the upper bounds for the LHSV described herein.

As noted above, the method for hydrodearylation may take place in one or more reactors. Flow reactors are well-suited for this process, although the subject matter described herein is not so limited. Exemplary flow reactors include, but are not limited to, a stirred tank reactor, an ebullated bed reactor, a baffled slurry tank, a fixed bed reactor, a rotating tubular reactor, a slurry-bed reactor, a moving-bed reactor, and a combination of two or more of these.

As a result of the hydrodearylation process using the FS-USY described herein, the American Petroleum Institute (hereinafter "API") density was improved from 10° to 20°, from 10° to 19°, from 10° to 18°, from 10° to 17°, from 10° to 16°, from 10° to 15°, from 10° to 14°, from 10° to 13°, from 10° to 12°, from 10° to 11°, from 11° to 20°, from 12° to 20°, from 13° to 20°, from 14° to 20°, from 15° to 20°, from 16° to 20°, from 17° to 20°, from 18° to 20°, or even from 19° to 20°. API density is determined in accordance with ASTM D287, the entire content of which is incorporated herein by reference.

According to an aspect, either alone or in combination with any other aspect, a method for hydrodearylating aromatic bottoms oil includes contacting at least one aromatic bottoms oil stream with at least one catalyst composition and hydrogen in a reactor in order to hydrodearylate the aromatic bottoms oil stream. The catalyst composition includes a catalyst support comprising framework-substituted ultra-stable Y-type (USY) zeolite substituted with at least zirconium atoms. The catalyst composition does not include a hydrogenative metal component disposed on the support.

According to a second aspect, either alone or in combination with any other aspect, the reactor has a temperature from 250° C. to 400° C.

According to a third aspect, either alone or in combination with any other aspect, the aromatic bottoms oil has a boiling point from 150° C. to 450° C.

According to a fourth aspect, either alone or in combination with any other aspect, the hydrogen is added to the reactor at a pressure from 0.5 MPa to 10 MPa.

According to a fifth aspect, either alone or in combination with any other aspect, the reactor has a hydrogen/oil ratio from 50 $Nm^3/m^3$ to 2000 $Nm^3/m^3$.

According to a sixth aspect, either alone or in combination with any other aspect, the reactor has a liquid hourly space velocity from 0.1 per hour to 10 per hour.

According to a seventh aspect, either alone or in combination with any other aspect, the reactor comprises a flow reactor selected from the group consisting of a stirred tank reactor, an ebullient bed reactor, a baffled slurry tank, a fixed bed reactor, a rotating tubular reactor, a slurry-bed reactor, and a combination of two or more of these.

According to an eighth aspect, either alone or in combination with any other aspect, the framework-substituted USY zeolite is substituted with from 0.1 wt. % to 5 wt. % zirconium atoms calculated on an oxide basis.

According to a ninth aspect, either alone or in combination with any other aspect, the catalyst composition further comprises an inorganic oxide.

According to a tenth aspect, either alone or in combination with any other aspect, the inorganic oxide comprises alumina, silica, titania, silica-alumina, alumina-titania, alumina-zirconia, alumina-boria, phosphorus-alumina, silica-alumina-boria, phosphorus-alumina-boria, phosphorus-alumina-silica, silica-alumina-titania, and silica-alumina-zirconia or a combination of two or more thereof.

According to an eleventh aspect, either alone or in combination with any other aspect, the framework-substituted ultra-stable Y-type zeolite is further substituted with titanium atoms.

According to a twelfth aspect, either alone or in combination with any other aspect, the framework-substituted USY zeolite is substituted with from 0.1 wt. % to 5 wt. % titanium atoms.

According to a thirteenth aspect, either alone or in combination with any other aspect, the framework-substituted USY zeolite comprises a crystal lattice constant from 2.42 nm to 2.45 nm.

According to a fourteenth aspect, either alone or in combination with any other aspect, the framework-substituted USY zeolite comprises a specific surface area from 600 $m^2/g$ to 900 $m^2/g$.

According to a fifteenth aspect, either alone or in combination with any other aspect, the catalyst composition comprises a specific surface area from 200 $m^2/g$ to 500 $m^2/g$.

According to a sixteenth aspect, either alone or in combination with any other aspect, the framework-substituted USY zeolite comprises a molar ratio of $SiO_2$ to $Al_2O_3$ from 12 to 100.

According to a seventeenth aspect, either alone or in combination with any other aspect, the framework-substituted USY zeolite comprises a plurality of pores having a diameter of 600 Å or less, the pores having a volume from 0.4 ml/g to 0.95 ml/g.

According to an eighteenth aspect, either alone or in combination with any other aspect, a catalyst composition includes a catalyst support comprising framework-substituted ultra-stable Y-type (USY) zeolite substituted with at least zirconium atoms. The catalyst composition does not include a hydrogenative metal component disposed on the support.

According to a nineteenth aspect, either alone or in combination with any other aspect, the framework-substituted USY zeolite is substituted with from 0.1 wt. % to 5 wt. % zirconium atoms calculated on an oxide basis.

According to a twentieth aspect, either alone or in combination with any other aspect, the catalyst composition further comprises an inorganic oxide.

According to a twenty-first aspect, either alone or in combination with any other aspect, the inorganic oxide comprises alumina, silica, titania, silica-alumina, alumina-titania, alumina-zirconia, alumina-boria, phosphorus-alumina, silica-alumina-boria, phosphorus-alumina-boria, phosphorus-alumina-silica, silica-alumina-titania, and silica-alumina-zirconia or a combination of two or more thereof.

According to a twenty-second aspect, either alone or in combination with any other aspect, the framework-substituted ultra-stable Y-type zeolite is further substituted with titanium atoms.

According to a twenty-third aspect, either alone or in combination with any other aspect, the framework-substituted USY zeolite is substituted with from 0.1 wt. % to 5 wt. % titanium atoms.

According to a twenty-fourth aspect, either alone or in combination with any other aspect, the framework-substituted USY zeolite comprises a crystal lattice constant from 2.42 nm to 2.45 nm.

According to a twenty-fifth aspect, either alone or in combination with any other aspect, the framework-substituted USY zeolite comprises a specific surface area from 600 $m^2/g$ to 900 $m^2/g$.

According to a twenty-sixth aspect, either alone or in combination with any other aspect, the catalyst composition comprises a specific surface area from 200 $m^2/g$ to 500 $m^2/g$.

According to a twenty-seventh aspect, either alone or in combination with any other aspect, the framework-substituted USY zeolite comprises a molar ratio of $SiO_2$ to $Al_2O_3$ from 12 to 100.

According to a twenty-eighth aspect, either alone or in combination with any other aspect, the framework-substituted USY zeolite comprises a plurality of pores having a diameter of 600 Å or less, the pores having a volume from 0.4 ml/g to 0.95 ml/g.

According to a twenty-ninth aspect, either alone or in combination with any other aspect, the framework-substituted ultra-stable Y-type (USY) zeolite is further substituted with hafnium atoms.

EXAMPLES

Using embodiments described above, an exemplary catalyst composition was prepared and characterized, as follows.

Synthesis of TiZr-USY Catalyst with Binder (Inventive)

A TiZr-USY zeolite was prepared as described in U.S. Pat. No. 10,293,332, the entire content of which is incorporated herein by reference.

A Y-type zeolite (Na-Y) is subjected to exchange of sodium ions with ammonium ions by a conventional method. In one exemplary method, the Y-type zeolite is dispersed in water to prepare a suspension, to which ammonium sulfate is added. The solid matter is then washed with water, followed by an ammonium sulfate aqueous solution at a temperature of 40° C. to 80° C. Then, the solid is further washed with water at 40° to 95° C. and dried at 100° C. to 180° C. for 30 minutes, thus producing an ammonium-exchanged Y-type zeolite in which 50% to 70% of sodium contained in the Y-type zeolite is substituted with $NH_4$.

Subsequently, a hydrogen type Y-type zeolite (HY) is prepared by calcining the above ammonium-exchanged Y-type zeolite at 500° C. to 800° C. for 10 minutes to 10 hours in a saturated vapor atmosphere. Then, an ammonium-exchanged Y-type zeolite in which 80% to 97% of sodium contained in the initial Y-type zeolite (Na-Y) is ion-exchanged with $NH_4$ can be obtained by dispersing the hydrogen type Y-type zeolite obtained above in water at 40° C. to 95° C. to prepare a suspension, to which ammonium sulfate is added. The suspension is stirred at 40° C. to 95° C. for 10 minutes to 3 hours. The solid matter is then washed with water at 40° C. to 95° C., followed by an ammonium sulfate aqueous solution at 40° C. to 95° C. Then, the solid is further washed with water at 40° C. to 80° C. and dried at 100° C. to 180° C. for 30 minutes to 30 hours. In this respect, the final ammonium ion exchange rate is at least 90%.

The ammonium-exchanged Y zeolite thus obtained is calcined at 500° C. to 700° C. for 10 minutes to 10 hours in, for example, a saturated vapor atmosphere, to provide an ultra-stable Y-type zeolite.

The ammonium-exchanged Y zeolite is then subjected to a treatment for removing extra-skeletal aluminum (aluminum atoms which do not form the zeolite framework). Extra-skeletal aluminum can be removed by, for example, dispersing the ultra-stable Y-type zeolite described above in warm water at 40° C. to 95° C. to prepare a suspension, adding sulfuric acid to the above suspension, and stirring the suspension for 10 minutes to 3 hours while maintaining the temperature at 40° C. to 95° C. to thereby dissolve the extra-skeletal aluminum. After dissolving the extra-skeletal aluminum, the suspension is filtered, and the filter residue is washed with purified water at 40° C. to 95° C. and dried at 100° C. to 180° C. for 3 to 30 hours. An ultra-stable Y-type zeolite from which the extra-skeletal aluminum is removed is thus obtained.

The ultra-stable Y-type zeolite from which the extra-skeletal aluminum is removed is calcined at 500° C. to 700° C. for 30 minutes to 10 hours. The calcined ultra-stable Y-type zeolite is suspended in water having a temperature of about 20° C. to about 30° C. to form a suspension with a liquid/solid mass ratio in the range of 5 to 15. Next, an inorganic acid or an organic acid is added so that a pH of the suspension is less than 2, and subsequently a solution containing a zirconium compound and a titanium compound is added gradually and mixed. The mixed solution is then neutralized (pH 7.0 to 7.5) and dried at 80° C. to 180° C., thus providing the TiZr-USY zeolite.

The TiZr-USY was then combined with a silica-alumina binder. To a 25 wt. % aqueous solution of $H_2SO_4$ was added a 9 wt. % aqueous suspension of $SiO_2$. To this mixture was added a 15 wt. % aqueous solution of $NH_3OH$ until the mixture achieved a pH of 7.0. This mixture was allowed to stir for approximately two hours at 40° C. A 5 wt. % $SiO_2$ hydro-gel was thus obtained. A 6.8 wt. % aqueous suspension of $NaAlO_2$ (on an $Al_2O_3$ basis) was mixed with the $SiO_2$ hydro-gel and a 2.5 wt. % $Al_2(SO_4)_2$ aqueous solution (on an $Al_2O_3$ basis). This mixture was allowed to stir for approximately 60 minutes at 60° C.

After this stirring, the product was washed with 150 L of a 0.3 mass % ammonia aqueous solution to remove $Na_2SO_4$. Next, water was added to the product from which $Na_2SO_4$ was removed to adjust an $Al_2O_3$ concentration to 10% by mass. The pH was adjusted to 10.5 with 15% aqueous ammonia by mass. The mixture was stirred at 95° C. for 10 hours, dehydrated, washed, and kneaded with a kneader, thereby providing a silica-alumina mixture.

The resulting silica-alumina mixture was mixed with the TiZr-USY in a dry mass ratio of 9:1. The mixture was kneaded with a kneader, formed into a columnar shape having a diameter of 1.8 mm, and fired at 550° C. for 3 hours, thereby affording the TiZr-USY catalyst with binder.

Formulation of TiZr-USY Catalyst with Binder with Active Phase Metals (Comparative)

The TiZr-USY catalyst with binder produced above was doped with molybdenum and nickel using conventional procedures. Briefly, the TiZr-USY catalyst with binder was immersed in an aqueous solution containing hydrogenation-active metal components and fired in the air at 550° C. for 1 hour. Here, the aqueous solution containing hydrogenation-active metal components was prepared by adding 700 mL of water to 201.3 g of molybdenum trioxide (an example of the hydrogenation-active metal component) and 90.4 g of nickel carbonate (an example of the hydrogenation-active metal component) and stirring the resulting mixture at 95° C. for 5 hours. Thus, an active metal doped TiZr-USY catalyst with binder was obtained.

Characterization of Catalyst Compositions

Table 1 provides the compositional analyses of Catalyst Composition 1 and Catalyst Composition 2. Specific surface area and pore volume were determined as follows. Adsorption measuring equipment (e.g., fully automatic gas adsorption equipment "AUTOSORB-1" manufactured by Quantachrome Instruments Corp.) was used to subject 0.02 to 0.05 g of a sample (zeolite or the catalyst composition) to deaeration treatment at room temperature for 5 hours. An adsorption desorption isothermal curve was measured under liquid nitrogen temperature to calculate a specific surface area per mass using a BET equation of a multipoint method. Further, a pore distribution and a pore volume (pore diameter: 600 Å or less) were calculated from a nitrogen adsorption isothermal curve by a BJH method. Compacted bulk density may be determined as follows. The sample was pre-calcined at 500° C. for one hour. The sample was then cooled in a dessicator. A volumetric cylinder was charged with 100 g of the dried sample, which was tamped down. From the volume of the sample, the compacted bulk density was calculated as the weight of the sample divided by its volume.

TABLE 1

Characterization of Catalyst Compositions

| Property | Catalyst Composition 1 (Inventive) | Catalyst Composition 2 (Comparative) |
|---|---|---|
| $MoO_3$ (wt. %) | 0 | 5 |
| NiO (wt. %) | 0 | 20 |
| $TiO_2$ (wt. %) | 0.08 | 0.06 |
| $ZrO_2$ (wt. %) | 0.08 | 0.06 |
| Specific Surface Area ($m^2/g$) | 460 | 300 |
| Pore volume (ml/g) | 0.88 | 0.60 |
| Compacted Bulk Density (g/ml) | 0.58 | 0.71 |

Pilot Plant Hydrocracking Process

Catalyst Composition 1 and Catalyst Composition 2 were both used in a hydro-dearylation process with a feed derived from a bottoms stream from a xylenes rerun column, where the bottoms stream includes alkyl bridged non-condensed alkyl multi-aromatic compounds. Hydrogen was added to a pilot plant at a partial pressure of 1.5 MPa with a hydrogen/oil ratio of 115 L/L and an LHSV of from 1.3 $h^{-1}$ to 1.6 $h^{-1}$. Reactions were performed at 300° C., 325° C., and 350° C.

Table 2 provides the operating conditions and results using Catalyst Composition 1. Table 3 provides the operating conditions and results using Catalyst Composition 2. In Table 2, the API density of the initial feed was found to be 10.5°. The average API density found over three experiments using Catalyst Composition 1 was 21.0°, an average increase in API density of 10.5° (a 100% increase). In Table 3, the API density of the initial feed was found to be 12.6°. The average API density found over three experiments using Catalyst Composition 2 was 16.7, an average increase in API density of 4.1° (a 33% increase). Thus, removing the active metal from the TiZr-USY containing catalyst composition results in a significant increase in the API density of the hydrodearylated petroleum product.

TABLE 2

Hydrodearylation Conditions and Results with Catalyst Composition 1

| | Hydrogen Pressure (MPa) | Temp. (° C.) | LHSV ($h^{-1}$) | API (°) | API Gravity Improvement (°) |
|---|---|---|---|---|---|
| Initial Feed | — | — | — | 10.5 | — |
| E1 | 15 | 300 | 1.32 | 20.7 | 10.2 |
| E2 | 15 | 325 | 1.5 | 21 | 10.5 |
| E3 | 15 | 350 | 1.5 | 21.4 | 10.9 |
| Average[1] | — | — | — | 21 | 10.5 |

[1]E1 + E2 + E3 /3.

TABLE 3

Hydrodearylation Conditions and Results with Catalyst Composition 2 (Comparative)

| | Hydrogen Pressure (MPa) | Temp. (° C.) | LHSV ($h^{-1}$) | API (°) | API Gravity Improvement (°) |
|---|---|---|---|---|---|
| Initial Feed | — | — | — | 12.6 | — |
| E1 | 15 | 300 | 1.6 | 15.1 | 2.5 |
| E2 | 15 | 325 | 1.59 | 17.3 | 4.7 |
| E3 | 15 | 350 | 1.58 | 17.8 | 5.2 |
| Average[1] | — | — | — | 16.7 | 4.1 |

[1]E1 + E2 + E3 /3.

It is noted that recitations in the present disclosure of a component of the present disclosure being "operable" or "sufficient" in a particular way, to embody a particular property, or to function in a particular manner, are structural recitations, as opposed to recitations of intended use. More specifically, the references in the present disclosure to the manner in which a component is "operable" or "sufficient" denotes an existing physical condition of the component and, as such, is to be taken as a definite recitation of the structural characteristics of the component.

Having described the subject matter of the present disclosure in detail and by reference to specific embodiments, it is noted that the various details disclosed in the present disclosure should not be taken to imply that these details relate to elements that are essential components of the various embodiments described in the present disclosure. Further, it will be apparent that modifications and variations are possible without departing from the scope of the present disclosure, including, but not limited to, embodiments defined in the appended claims.

The singular forms "a", "an" and "the" include plural referents, unless the context clearly dictates otherwise.

Throughout this disclosure ranges are provided. It is envisioned that each discrete value encompassed by the ranges are also included. Additionally, the ranges which may be formed by each discrete value encompassed by the explicitly disclosed ranges are equally envisioned.

As used in this disclosure and in the appended claims, the words "comprise," "has," and "include" and all grammatical variations thereof are each intended to have an open, non-limiting meaning that does not exclude additional elements or steps.

As used in this disclosure, terms such as "first" and "second" are arbitrarily assigned and are merely intended to differentiate between two or more instances or components. It is to be understood that the words "first" and "second" serve no other purpose and are not part of the name or description of the component, nor do they necessarily define a relative location, position, or order of the component. Furthermore, it is to be understood that that the mere use of the term "first" and "second" does not require that there be any "third" component, although that possibility is contemplated under the scope of the present disclosure.

What is claimed is:

1. A method for hydrodearylating aromatic bottoms oil, comprising:

contacting at least one aromatic bottoms oil stream with at least one catalyst composition and hydrogen in a reactor in order to hydrodearylate the aromatic bottoms oil stream, the catalyst composition comprising:

a catalyst support comprising framework-substituted ultra-stable Y-type (USY) zeolite substituted with at least zirconium atoms;

with the proviso that the catalyst composition does not comprise a hydrogenative metal component disposed on the support.

2. The method of claim 1, wherein the reactor has a temperature from 250° C. to 400° C.

3. The method of claim 1, wherein the aromatic bottoms oil has a boiling point from 150° C. to 450° C.

4. The method of claim 1, wherein the hydrogen is added to the reactor at a pressure from 0.5 MPa to 10 MPa.

5. The method of claim 1, wherein the reactor has a hydrogen/oil ratio from 50 $Nm^3/m^3$ to 2000 $Nm^3/m^3$.

6. The method of claim 1, wherein the reactor has a liquid hourly space velocity from 0.1 per hour to 10 per hour.

7. The method of claim 1, wherein the reactor comprises a flow reactor selected from the group consisting of a stirred tank reactor, an ebullient bed reactor, a baffled slurry tank, a fixed bed reactor, a rotating tubular reactor, a slurry-bed reactor, and a combination of two or more of these.

8. The method of claim 1, wherein the framework-substituted ultra-stable Y-type zeolite is further substituted with titanium atoms.

9. The method of claim 8, wherein the framework-substituted USY zeolite is substituted with from 0.1 wt. % to 5 wt. % titanium atoms.

* * * * *